United States Patent [19]

Lödige et al.

[11] 4,236,677

[45] Dec. 2, 1980

[54] APPARATUS FOR TREATING BULK MATERIAL IN BATCHES

[76] Inventors: Wilhelm Lödige, Elsenerstr. 9c; Fritz Lödige, Leuschnerstr. 12; Joseph Lucke, Im Lohfeld 14; Roland Lucke, Karl-Arnold-Allee 3, all of D-4790 Paderborn, Fed. Rep. of Germany

[21] Appl. No.: 2,607

[22] Filed: Jan. 11, 1979

Related U.S. Application Data

[63] Continuation-in-part of Ser. No. 958,811, Nov. 8, 1978, abandoned, which is a continuation of Ser. No. 841,528, Oct. 12, 1977, abandoned.

[30] Foreign Application Priority Data

Oct. 15, 1976 [DE] Fed. Rep. of Germany ..... 2646512

[51] Int. Cl.[3] ..... B02C 17/16

[52] U.S. Cl. ..... 241/172; 241/174

[58] Field of Search ..... 241/23, 30, 102, 172, 241/173, 174, 184

[56] References Cited

U.S. PATENT DOCUMENTS

| | | | |
|---|---|---|---|
| 1,807,383 | 5/1931 | Carnahan | 241/184 X |
| 1,864,542 | 6/1932 | Holzapfel | 241/184 |
| 3,008,656 | 11/1961 | Weston | 241/184 X |
| 3,018,059 | 1/1962 | Lodige et al. | 241/174 X |
| 3,329,348 | 7/1967 | Pootmans | 241/172 X |

*Primary Examiner*—Mark Rosenbaum

*Attorney, Agent, or Firm*—Thomas J. Greer, Jr.

[57] ABSTRACT

An apparatus and process is disclosed for treating bulk material in batches in a container having a revolving shovel mechanism rotatably mounted therein and ball-like striking elements moved by the shovel mechanism, wherein heat is supplied to or removed from the bulk material and/or the bulk material is dried and the striking elements are added to the bulk material for the duration of the treatment. The ball-like striking elements having a substantially higher specific gravity than the bulk material and a diameter of at least twice the smallest distance between the shovel tools of the shovel mechanism and the container wall. The shovel tools each having a forwardly extending portion which is curved. The curved portion imparts a resultant of tangential and radial motions to the ball striking elements when contacted thereby.

1 Claim, 5 Drawing Figures

APPARATUS FOR TREATING BULK MATERIAL IN BATCHES

This is a Continuation-in-Part of application Ser. No. 958,811, filed Nov. 8, 1978, entitled "Process for Treating Bulk Material in Batches", now abandoned which application was a continuation of Ser. No. 841,528, filed Oct. 12, 1977, also entitled "Process for Treating Bulk Material in Batches", and now abandoned.

The invention relates to a process for treating bulk material in batches in a container having a rotatably mounted revolving shovel mechanism therein and striking elements moved by the shovel mechanism, wherein heat is supplied to or removed from the bulk material and/or the bulk material is dried.

A process for sterilizing bulk material is known from U.S. Pat. No. 3,721,527, issued Mar. 20, 1973, in which the bulk material is intensively loosened up and whirled in a closed container by means of a shovel mechanism which may revolve at high speed if necessary, and vapour such as saturated steam is simultaneously added as a sterilization agent. Once the sterilization period has elapsed and the sterilization agents have been drawn off, the bulk material is drived with further intensive loosening up and whirling by means of heat supplied through the container wall. It has been found that at least part of the vapour used for sterilization condenses during the treatment period and moistens the bulk material, so that some material is deposited on the container wall and cannot be removed by the revolving shovels or other tools of the shovel mechanism since these tools have to revolve at a certain minimum distance from the container wall. The transfer of heat through the container wall and thus the heat transfer efficiency is impaired by such deposits of material on the container wall and this leads to unnecessary losses of energy.

This problem applies to all processes in which heat is supplied to or discharged from a product through the wall of a container having a shovel mechanism therein, and in particular to drying processes of this type. In many cases, the materials to be treated tend to cake and to form a crust on the container wall as a result of previous treatment so that these deposits of material can only be carried off imperfectly by the tools revolving in the container, since a minimum distance must remain between the container wall and the outer end of the tools. When the container has parts which extend through its wall, such as extra communication devices, the tools revolving in the container do not completely brush over the wall of the container.

In drying technology, particularly in the case of vacuum dryers of horizontal type having a revolving shovel mechanism rotatably mounted therein, it is known to layer loose striking rods in the container to prevent material from being deposited on the wall. These striking rods are lifted by the shovel mechanism as it rotates and fall back out of the region at the top of the container on to the container wall and thus detach encrusted material. However, if such a dryer is to function at speeds above the critical speed, in other words at speeds at which the bulk material to be treated forms a so-called ring of material on the container wall, such striking rods cannot be used since they revolve with the shovel mechanism owing to the centrifugal force produced by the high speed of the shovel mechanism and, in any case, would roll along the container wall, although it is more likely that they would revolve at a distance from the container wall and pack bulk material between themselves and the container wall thus promoting the formation of deposits of material instead of reducing them. Another disadvantage of the striking rods is that they can easily damage the tools of the shovel mechanism, particularly at relatively high speeds, and also only fall back against certain areas of the container wall at lower speeds. Consequently, they cannot remove deposits of material from all parts of the container wall. Finally, when using striking rods, it is also necessary to use shovel tools of a particular type which left the striking rod sufficiently high in the container for the striking rods to be able to drop against the container wall effectively.

The object of the invention is to prevent caking and incrustion of material when treating batches of bulk material in a container and particularly in a closed container with a shovel mechanism revolving therein, using simple means, even at speeds above the critical speed of the shovel mechanism.

This object is achieved in accordance with the invention by providing spherical bodies as striking elements for the bulk material, at least for the duration of the treatment. These spherical bodies are to have a specific gravity which is substantially higher than that of the bulk material and a diameter equal to at least twice the smallest distance between the tools of the shovel mechanism and the container wall. Balls are preferably used as the striking elements.

The object of the invention is further achieved by providing the shovel tool elements of the shovel mechanism with forwardly extending portions having curved surfaces, the forward extensions being in the direction of rotation of the shovels. Each forwardly extending and curved surface of the shovels contacts the mixing ball elements as well as the bulk material being treated. In certain prior art constructions, such as U.S. Pat. No. 3,471,093 issued to Wienert, rotating arms which are similarly positioned on a horizontal rotating shaft are provided with paddle elements at their outer tips. Further, similar to the present invention, the Wienert construction employs a plurality of ball elements. A consideration of the Wienert construction shows that when the outer tips of the arms contact the ball elements, the latter are urged in a generally tangential direction, i.e., tangential to the motion of that part of the arms which strike them. The material being dried or otherwise treated contacted by the tips also moves in a generally tangential direction. While apparently satisfactory for the purpose intended, the Wienert construction does not, in general, perform bulk treatment as well as the present construction.

By virtue of the practice of this invention, the disposition and shape of the curved surfaces causes the ball elements to move in a radially inwardly direction. Thus, the curved surfaces of the shovel elements impart a combination of tangential and radial velocities or motions to the mixing balls. Further, the curved surfaces also impart a combination of tangential and radial motions to the bulk material being treated.

The invention advantageously uses balls which have a diameter of from two to about twenty times the smallest distance between the shovel tools of the shovel mechanism and the inner container wall, that is to say, they cannot settle or become lodged between the ends of the tools of the shovel mechanism and the container wall. If larger balls are used, these may be re-used many times, their size allowing for a certain amount of wear and tear. In this case, care must be taken not to allow the diameter of the balls to drop substantially below twice the distance between the outer ends of the shovel tools of the shovel mechanism.

According to another aspect of the invention, a sufficient number of balls is used to cover at least 20% of the container wall in an imaginary coating of a layer of balls. In other words, enough balls are used to cover 20% or more of the area of the internal wall of the container, when placed in a layer. Such a quantity of balls is sufficient to ensure that the entire container wall is always mechanically processed uniformly to reduce deposits of material forming there as soon as they are produced. This is achieved because the balls continuously roll over the entire internal wall of the container, in particular at relatively high speeds, for example at speeds above the critical speed when a ring of material is formed on the internal wall of the cylindrical container. However, even at low speeds when the bulk material is heaped to some extent on the bottom of the container and the tools of the shovel mechanism penetrate these heaps, the invention ensures that material is not deposited on the wall since the tools of the shovel mechanism move the balls everywhere where there is bulk material and thus where material may be deposited on the container wall.

Balls made of a metal such as steel are preferably used since this material is particularly durable and hard wearing. Balls made of ceramic material or rubber balls with steel reinforcement may, however, be used instead, depending, amongst other things, on the bulk material to be treated and the desired end product.

In one ball embodiment of the invention, the balls have a smooth surface. According to another modification of the invention, however, the balls have sharp edges or cutting edges on their surfaces, for example by being provided with polygonal recesses such as hexagonal recesses. The sharp edges or cutting edges formed in this way improve the ability to detach crusts and other forms of deposits of material from the container interior wall.

In the invention, instead of introducing striking rods into the container for detaching incrusted material and deposits on the wall, a plurality of spherical bodies are used which mix with the bulk material during treatment and are repeatedly thrust in a generally uniform distribution against the internal wall of the container along the entire length thereof in order to detach and also to reduce incrusted material and deposits of material for integration in the bulk material. In spite of this fact, the separation of the spherical bodies from the treated bulk material does not cause problems since it can be carried out by simple sieving. Sieving is also feasible with sterilized bulk materials because it can be carried out in a sterile environment, for example in an enclosed outlet pipe of the treatment container from which the spherical bodies which have been separated off are recycled into the container and may thus be used again immediately for treating the next batch.

The invention may be used in any process for treating bulk material in a container having a revolving shovel mechanism rotatably mounted therein, in which process heat is to be supplied or removed through the container wall, for example in a vacuum contact drying process, in a ventilation drying process, and also in a normal mixing process in which a heating or cleaning treatment is to be carried out from the outside during the mixing process. Although the invention is preferably used for batch operation, it is also conceivable to use it for the continuous treatment of bulk materials, since it is possible to supply and re-separate the spherical bodies in a bulk material which continuously runs through a container.

IN THE DRAWINGS

Figure 1:
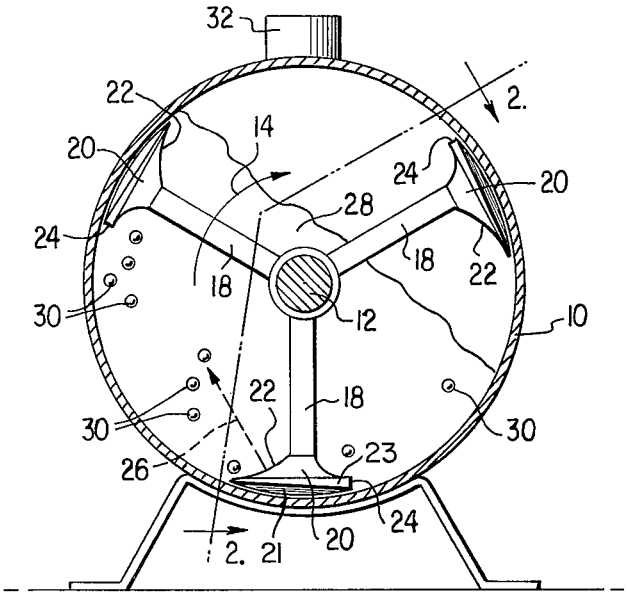
FIG. 1 is a longitudinal cross-section of the bulk treatment apparatus according to the practice of this invention.
Figure 2:
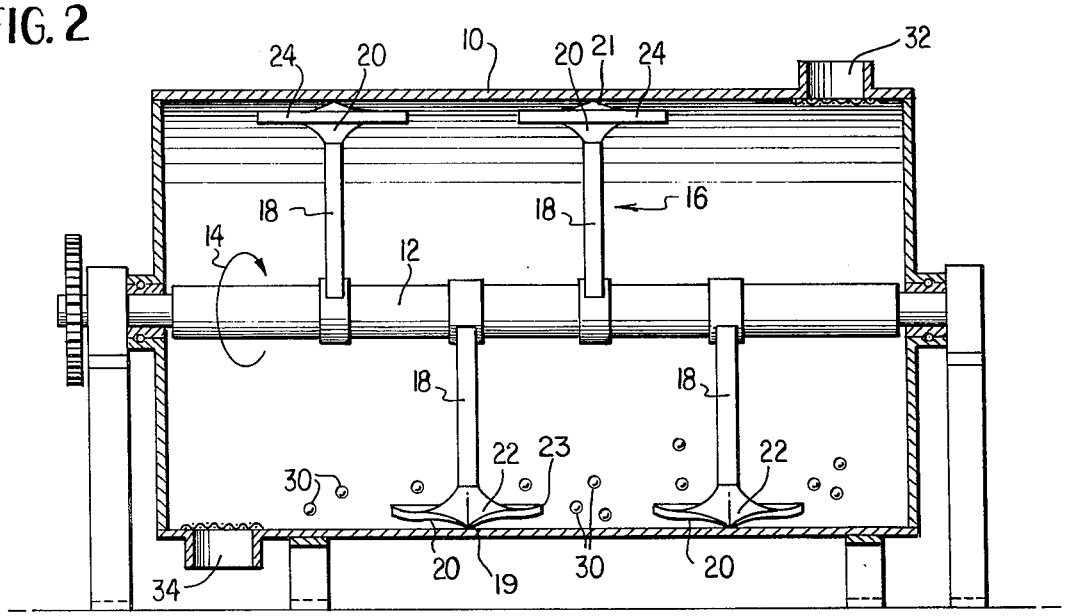
FIG. 2 is a view taken along section 2—2 of FIG. 1.

Referring now to the drawings, and particularly FIGS. 1 and 2, the numeral 10 denotes generally the bulk treatment apparatus of this invention and is defined by a horizontally disposed, fixed cylinder through which passes a shaft 12 rotatable about a horizontal axis, the rotation denoted by the numeral 14. The reader will understand that the cylinder 10 is stationary, and, as is conventional in this art, may be provided with a heating jacket for the purpose of heating the contents thereof. The numeral 16 denotes any one of a plurality of radially extending arms, each arm defined by a spoke member 18 secured, as by welding or otherwise, to shaft 12 and projecting radially outwardly therefrom and including a radially outermost or tip tool shovel portion denoted by the numeral 20. Such shovel 20 is of considerable axial extent and, as may be seen from a consideration of FIG. 1, includes a forward portion extending in the direction of rotation of the shovel mechanism, the forward portion having a curved surface 22. The rear portion of each shovel is denoted by the numeral 24. As will be obvious from FIGS. 1 and 2 of the drawings, each shovel 20 includes a forward pointed tip 19 which is closely spaced from an inner surface of the container or cylinder 10. Also, each shovel 20 has a circumferentially extending central portion 21 extending rearwardly from the tip 19 and being substantially uniformly spaced from the cylinder inner surface. Additionally, each shovel has a generally planar peripheral edge 23 including the rear portion or trailing edge 24. As is clearly shown in FIG. 2, the peripheral edge generally curves radially inwardly in an opposite axial direction from the tip 19. It will also be apparent from FIG. 2 that the shovels 20 have an axial extent created in the spacing of the arms 18 along the shaft 12 wherein upon each rotation of the shaft 12 all areas of the cylinder inner surface between remote ones of the shovels 20 have a shovel presented thereto. The numeral 26 denotes a typical trajectory or path of motion imparted to any one of the ball elements 30 of this invention, which are placed in the interior of the drum for the purpose of effecting and facilitating drying in a manner previously explained, when struck by curved surface 22 of a tip 20. The motion 26 is seen to be the resultant of both tangential and radial motions. This is in distinction to prior art constructions, such as the Wienert construction, wherein the radially outermost tip of each of the arms similar to 16 is flat and thus imparts a solely tangential direction of motion to the ball elements and to the bulk material 28 within the horizontal drum.

As shown at FIG. 2, one upper end of the drum may be provided with an inlet denoted by the numeral 32 and the left lower portion with an outlet denoted by the numeral 34, all for the purpose of facilitating passage through drum 10 of bulk material 28 which is to be treated or dried. Thus, the construction of this invention may be employed with continuous or batch operation of bulk material. FIG. 2 also illustrates the sequential overlap, in an axial direction, of the shovels 20. Thus, all (except for the right and left ends of the container) of the bulk material adjacent the inner periphery is contacted by a shovel.

Figure 3:
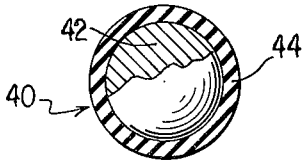
FIG. 3 is a cross-section of a ball striking element formed in accordance with one embodiment.
Figure 4:
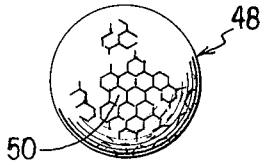
FIG. 4 is a view illustrating another embodiment of a ball element.
Figure 5:
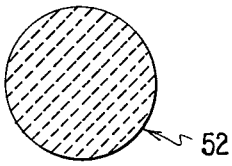
FIG. 5 is a view illustrating still another embodiment of a ball element.

FIG. 3 illustrates a striking ball element 40 having a steel or other metal center 42 covered by an elastomer coating or shell 44. In FIG. 4, a striking ball 48 may be formed of a suitable material, and the surface provided with generally hexagonal recesses 40 which may have sharp edges. FIG. 5 illustrates a striking ball 52 formed of ceramic, the ball having a smooth surface.

I claim:

1. An apparatus for treating bulk material, said apparatus comprising a generally cylindrical container having a generally horizontal axis, a shaft having an axis common with said generally horizontal axis and being rotatably journalled in said container, drive means for rotating said shaft, a plurality of shovel units mounted on said shaft for rotation with said shaft within said container, each of said shovel units including a radially extending arm having an inner end fixedly secured to said shaft and an outer end carrying a shovel element, each of said shovel elements including a forward pointed tip closely spaced from an inner surface of said container, each shovel element having a circumferentially extending central portion extending rearwardly from said tip and being substantially uniformly spaced from said container inner surface, each of said shovel elements having a generally planar peripheral edge terminating in a trailing edge and generally curving radially inwardly and in opposite axial directions from said tip, striking elements in the form of balls loosely disposed within said container for use in preventing caking and incrustation of bulk material on the inner surface of said container, said balls being of a minimum size to prevent wedging of said balls between said shovel elements and said container, each of said shovel elements having an axial extent greater than the spacing of said arms along said shaft wherein upon each rotation of said shaft all areas of said container inner surface between remote ones of said shovel elements has a shovel element presented thereto, and each of said shovel elements having a radially inner surface curving radially inwardly from said tip in circumferential and axial direction for imparting to said balls and bulk material being treated a tangential and radial motion away from said inner surface of said container.

* * * * *